US007596882B2

(12) United States Patent
Im et al.

(10) Patent No.: US 7,596,882 B2
(45) Date of Patent: Oct. 6, 2009

(54) TREATER OVEN FOR MANUFACTURING PREPREG

(75) Inventors: Ye-Hoon Im, Daejeon (KR); In-Seon Kim, Daejeon (KR); Sang-Phil Han, Daejeon (KR)

(73) Assignee: LG Chem, Ltd. (KR)

( * ) Notice: Subject to any disclaimer, the term of this patent is extended or adjusted under 35 U.S.C. 154(b) by 634 days.

(21) Appl. No.: 10/543,831

(22) PCT Filed: May 13, 2005

(86) PCT No.: PCT/KR2005/001408

§ 371 (c)(1),
(2), (4) Date: Jul. 29, 2005

(87) PCT Pub. No.: WO2005/111499

PCT Pub. Date: Nov. 24, 2005

(65) Prior Publication Data

US 2006/0275727 A1 Dec. 7, 2006

(30) Foreign Application Priority Data

May 13, 2004 (KR) ..... 10-2004-0033785
May 13, 2005 (KR) ..... 10-2005-0039954

(51) Int. Cl.
*F26B 7/00* (2006.01)

(52) U.S. Cl. ..... 34/60; 34/80; 34/90; 166/32; 126/91 A; 126/21 R; 432/143; 432/147; 219/400; 318/7; 427/452

(58) Field of Classification Search ..... 34/380, 34/60, 77, 78, 80, 90, 134, 137, 201; 219/400; 318/7; 427/452, 146; 432/143, 147; 126/91 A, 126/21 R; 166/32, 303
See application file for complete search history.

(56) References Cited

U.S. PATENT DOCUMENTS 2,134,229 A * 10/1938 Lipscomb ..... 432/130

(Continued)

FOREIGN PATENT DOCUMENTS

JP 02-58554 12/1990

(Continued)

*Primary Examiner*—Stephen M. Gravini
(74) *Attorney, Agent, or Firm*—McKenna Long & Aldridge LLP

(57) ABSTRACT

A treater oven for drying a prepreg includes: a pipe conduit configured such that the prepreg is able to pass therethrough; a the first structure connected to one side of the pipe conduit and supplying heated air to the pipe conduit; and the second structure connected to the other side of the pipe conduit and discharging the heated air from the pipe conduit. The first structure includes: an air supply portion connected to a heat exchanger and supplying the heated air; an air distribution discharge portion discharging the heated air supplied from the air supply portion through a pair of discharging outlets in both sides of the prepreg; and at least one perforated plate symmetrically disposed in air passageways of the air distribution discharge portion.

5 Claims, 7 Drawing Sheets

U.S. PATENT DOCUMENTS 2,590,757 A * 3/1952 Cornelius, Jr. et al. ..... 264/120
2,788,542 A * 4/1957 Swalm, Jr. et al. ..... 34/648
3,126,578 A * 3/1964 Chapman ..... 100/325
3,128,160 A * 4/1964 Bascom ..... 34/82
3,436,065 A * 4/1969 Flynn ..... 432/9
3,529,358 A * 9/1970 Robinson ..... 34/494
3,590,495 A * 7/1971 Tyson et al. ..... 34/654
3,614,388 A * 10/1971 Robinson ..... 219/400
3,643,342 A * 2/1972 Tyson et al. ..... 34/555
3,757,427 A * 9/1973 Wilkinson ..... 34/479
3,802,090 A * 4/1974 Delhaye et al. ..... 34/341
4,082,532 A * 4/1978 Imhof ..... 71/8
4,216,592 A * 8/1980 Koch, II ..... 34/68
4,287,138 A * 9/1981 Buckner ..... 261/128
4,287,671 A * 9/1981 Koch, II ..... 34/446
4,377,040 A * 3/1983 Giebeler et al. ..... 34/409
4,416,068 A 11/1983 Nilsson et al.
4,462,383 A * 7/1984 Henke et al. ..... 126/21 A
4,501,318 A * 2/1985 Hebrank ..... 165/7
4,548,847 A * 10/1985 Aberson et al. ..... 428/74
4,640,344 A * 2/1987 Pravda ..... 165/86
4,696,115 A * 9/1987 Spadafora ..... 34/524
5,193,293 A * 3/1993 Gabalda et al. ..... 34/68
5,193,996 A * 3/1993 Mullen ..... 432/59
5,259,124 A * 11/1993 Poterala ..... 34/638
5,263,265 A * 11/1993 Melgaard ..... 34/421
5,332,882 A * 7/1994 Gabalda et al. ..... 219/388
5,423,133 A * 6/1995 Annen et al. ..... 34/585
5,548,907 A * 8/1996 Gourdine ..... 34/448
5,604,994 A * 2/1997 Annen et al. ..... 34/314
5,866,877 A 2/1999 Maetani et al.
6,146,448 A * 11/2000 Shaw et al. ..... 95/287
6,546,646 B1 * 4/2003 Thomas ..... 34/412
6,701,637 B2 * 3/2004 Lindsay et al. ..... 34/71
7,024,800 B2 * 4/2006 Gorbell et al. ..... 34/576
7,318,288 B2 * 1/2008 Zahedi et al. ..... 34/381
7,487,601 B2 * 2/2009 Carin et al. ..... 34/381
7,501,082 B2 * 3/2009 Mencke ..... 264/40.1
2002/0152630 A1 * 10/2002 Lindsay et al. ..... 34/111
2004/0040176 A1 * 3/2004 Mencke ..... 34/445
2006/0010714 A1 * 1/2006 Carin et al. ..... 34/514
2006/0101665 A1 * 5/2006 Carin et al. ..... 34/513
2006/0150438 A1 * 7/2006 Niklaus et al. ..... 34/444
2006/0201024 A1 * 9/2006 Carin et al. ..... 34/576
2006/0254081 A1 * 11/2006 Carin et al. ..... 34/576
2007/0214676 A1 * 9/2007 Zahedi et al. ..... 34/86
2008/0104858 A1 * 5/2008 Carin et al. ..... 34/282
2008/0110043 A1 * 5/2008 Carin et al. ..... 34/487
2008/0189979 A1 * 8/2008 Carin et al. ..... 34/576
2008/0289211 A1 * 11/2008 Pinkham et al. ..... 34/259
2008/0289788 A1 * 11/2008 Pinkham et al. ..... 162/375
2009/0013596 A1 * 1/2009 Wang ..... 47/17

FOREIGN PATENT DOCUMENTS

JP 03-64715 6/1991
JP 07-080835 3/1995
JP 08-035772 2/1996
KR 1020000011611 2/2000

* cited by examiner (a) (b)

(a) (b)

TREATER OVEN FOR MANUFACTURING PREPREG

This application claims priority to PCT/KR2005/001408, filed on May 13, 2005, and Korean Application Nos. 10-2004-0033785 and 10-2005-0039954, filed May 13, 2004 and May 13, 2005, respectively, in Korea, all of which are hereby incorporated by reference in their entirety.

BACKGROUND OF THE INVENTION (a) Field of the Invention

The present invention relates to a treater oven, which is a device necessary in the process of manufacturing a prepreg.

(b) Description of the Related Art

Generally, a treater oven dries and solidifies resin on a fabric using convection heat transfer by heated air with high temperature, and radiation heat transfer by heat plates attached to the wall of the treater oven.

The radiation heat transfer is not affected by flow characteristics, but the convection heat transfer is different. Heat can be uniformly transferred by the convection heat transfer only when the air flow inside the treater oven is uniformly distributed. That is, in order to uniformly dry and solidify resin on the fabric, air flow inside the treater oven must be maintained to be uniform, and thereby a prepreg having a uniform gel time of the solidified resin, which is an important physical property, can be manufactured.

A conventional treater oven provides heated air from the heat exchanger to an air supply portion through a single pipe to an upper air inlet portion thereof, and branches off the supplied air in the air supply portion to an air distribution discharge portion having a pair of inlets, and thereby the heated air is introduced into a passageway where the fabric passes.

The introduced heated air passes by the front and rear of the fabric and dries/solidifies the fabric together with the radiation heat of the heat plates. However, since the flow of heated air from the air supply portion to the air distribution discharge portion is not symmetrically distributed to both inlets, amounts of air passing both sides of the fabric are different from each other, so that amounts of heat transfer are also different and accordingly there is a temperature difference between both sides of the fabric.

Furthermore, in the conventional treater oven, in order to achieve a uniform velocity distribution of heated air all through the whole pipe conduit guide vanes are installed inside the air distribution discharge portion in order to divide the heated air evenly to left, center, and right segments on the fabric, and dampers are also disposed in each of these segments to control the amount of heated air flow. However, since it is impossible to maintain a uniform air velocity, which is changed depending on the lapse of time, the kind of prepreg, and the temperature condition, the gelation time varies in front and rear portions and in left and right portions of the prepreg, so that inferior goods may be manufactured.

SUMMARY OF THE INVENTION

Therefore, the present invention has been made in an effort to solve the above problems. One object of the present invention is to provide a treater oven in which heated air can be equally distributed to the front and rear of a fabric from an inlet of the air supply portion.

In addition, another object of the present invention is to provide a treater oven in which heated air can be uniformly distributed and discharged from an air distribution discharge portion to the fabric throughout the whole fabric width.

To achieve the objects stated above, in a treater oven according to the embodiment of the present invention, an air supplying structure is formed in an empty tube type in which any guide vanes and dampers are not provided, and at least one perforated plate is installed to build up back pressure.

A treater oven for drying a prepreg according to the embodiment of the present invention includes a pipe conduit, the first structure, and the second structure. The pipe conduit is configured such that the prepreg is able to pass therethrough. The first structure is connected to one side of the pipe conduit and supplies heated air to the pipe conduit. The second structure is connected to the other side of the pipe conduit and discharges the heated air from the pipe conduit.

The first structure includes an air supply portion, an air distribution discharge portion, and at least one perforated plate. The air supply portion is connected to a heat exchanger and supplies the heated air. The air distribution discharge portion discharges the heated air supplied from the air supply portion through a pair of discharging outlets in both sides of the prepreg. At least one perforated plate is symmetrically disposed per each air passageway of the air distribution discharge portion.

An inlet for a connection with a single pipe connected to the heat exchanger may be formed on one side of the air supply portion and a pair of outlets are formed on the side opposite to the inlet, and at least a pair of perforated plates are respectively disposed at entrances of the air passageways that are connected respectively to the pair of outlets of the air supply portion.

Each air passageway of the air distribution discharge portion may be formed by an empty duct conduit.

The at least one perforated plate may further include a pair of second perforated plates that are symmetrically disposed respectively at the upstream of the pair of the discharging outlets of the air distribution discharge portion.

The at least one perforate plate may further include a pair of third perforated plates that are disposed apart from the second perforated plates with a predetermined gap at the upstream of the pair of the discharging outlets of the air distribution discharge portion.

DETAILED DESCRIPTION OF THE PREFERRED EMBODIMENTS

An embodiment of the present invention will now be described in detail with reference to the accompanying drawings.

Figure 1:
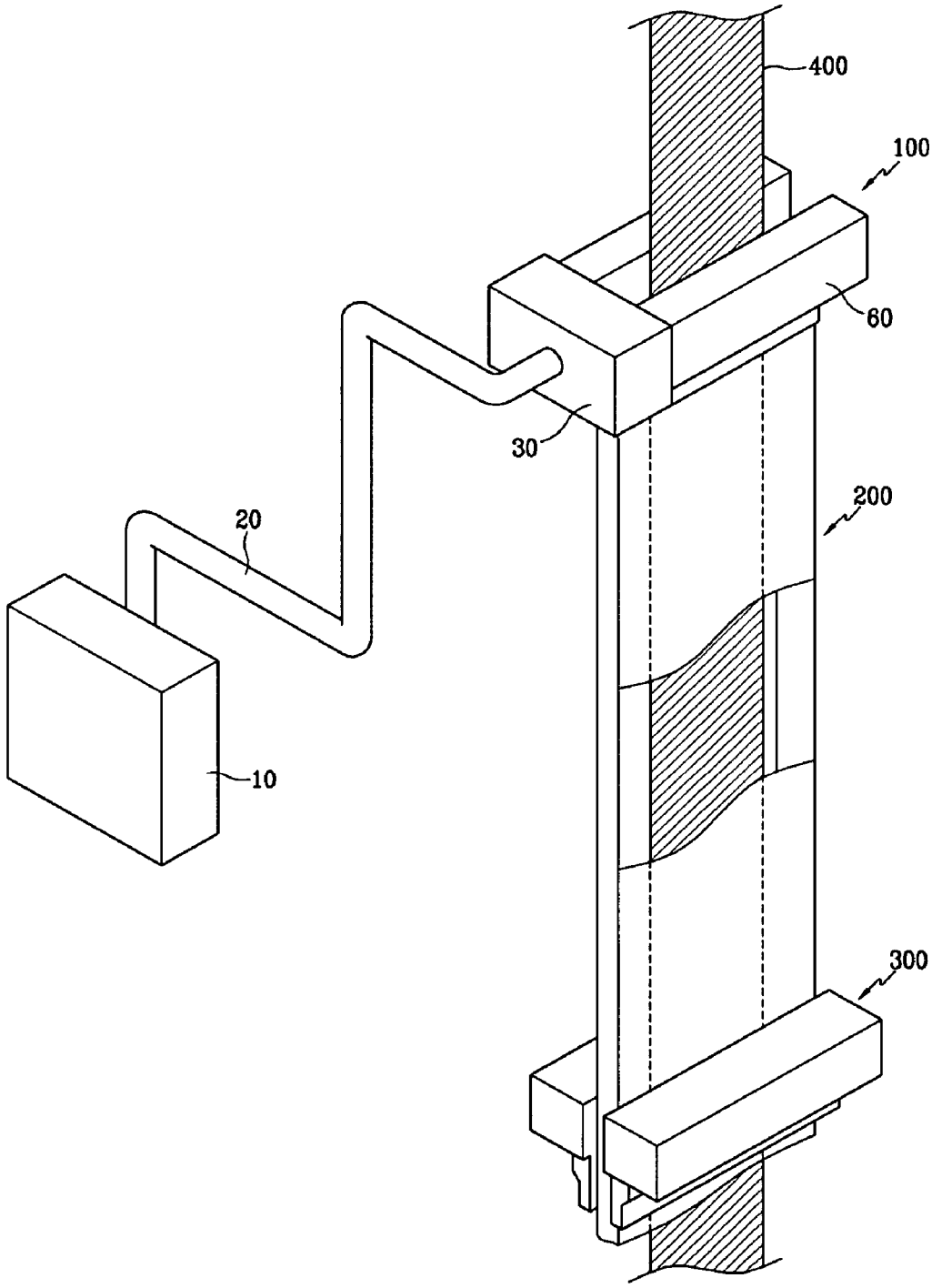
FIG. 1 schematically shows a treater oven for drying a prepreg according to an embodiment of the present invention.

FIG. 1 schematically shows a treater oven for drying a prepreg according to an embodiment of the present invention.

Referring to FIG. 1, a treater oven for drying a prepreg includes a pipe conduit 200 configured such that the prepreg is able to pass therethrough, i.e., defining a passage of the prepreg, the first structure connected to one side of the pipe conduit 200, and the second structure 300 connected to the other side of the pipe conduit 200.

In the present embodiment, the first structure 100 is coupled to the upper end portion of the pipe conduit 200, and the second structure 300 is coupled to the lower end portion of the pipe conduit 200. Hereinafter, the first structure 100 is called the upper structure 100, and the second structure 300 is called the lower structure 300.

A prepreg 400 is inserted through the upper structure 100, passes through the pipe conduit 200, and finally is discharged through the lower structure 300. The prepreg 400 is dried by heated air while moving from the upper structure 100 to the lower structure 300. For example, the prepreg 400 may be a prepreg of copper clad laminate. The prepreg 400 may be manufactured by coating resin onto a glass fabric, and then drying and solidifying by using heated air and heat plates.

The upper structure 100 includes: an air supply portion 30 that is connected to a heat exchanger 10 via a single pipe 20; an air distribution discharge portion 60 that is connected to the air supply portion 30 and distributes supplied air into the pipe conduit 200; and at least one perforated plate symmetrically disposed in the pair of air passageways of the air distribution discharge portion 60 to form back pressure.

That is, heated air with high temperature is supplied from the heat exchanger 10 to the air supply portion 30 of the upper structure 100 via the single pipe 20, a direction of heated air flow is changed while passing the air passageway inside the air distribution discharge portion 60, and the heated air is then downwardly discharged into the pipe conduit 200 through the pair of discharging outlets. The discharged heated air flows along the front and the rear of the fabric, and thereby the fabric is dried and solidified by uniform heat transfer.

The pipe conduit 200 defines the passageway 201 through which the prepreg 400 passes.

Connections between the single pipe 20, the air supply portion 30 and the distribution discharge portion 60 will be explained in detail.

Figure 2:
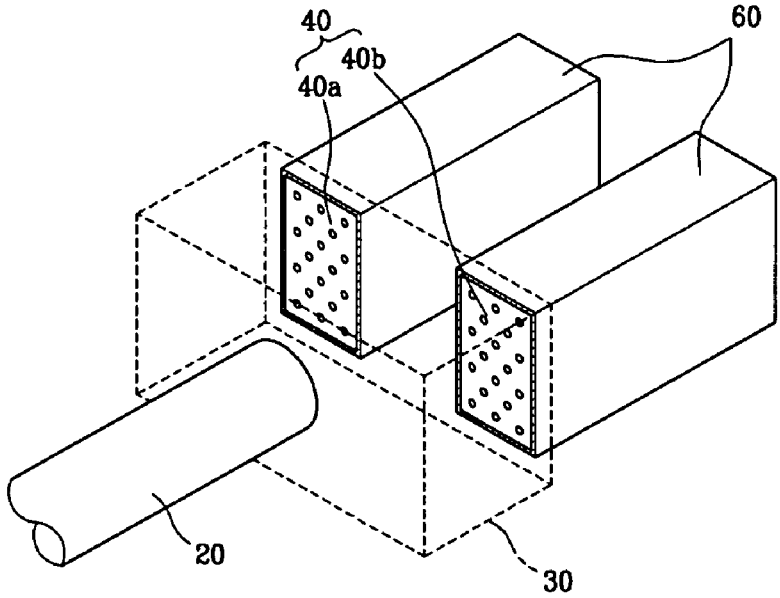
FIG. 2 shows a connection state of an upper structure of the treater oven shown in FIG. 1.

FIG. 2 shows connections of the single pipe 20, the air supply portion 30 and the air distribution discharge portion 60.

As shown in FIG. 2, a heated air inlet connected to the single pipe 20 is formed on one side of the air supply portion 30, and a pair of outlets through which heated air is dividedly discharged are formed on the other side opposite to the inlet.

The heated air supplied from the single pipe 20 is branched off to the pair of outlets and is then supplied to the air passageway 61 inside the air distribution discharge portion 60.

After passing the air passageway 61 of the air distribution discharge portion 60, the heated air is supplied into the passageway 201 within the pipe conduit 200, and the supplied heated air flows along the both sides of the prepreg 400.

At this time, the heated air is branched off at a connecting portion of the air supply portion 30 and the air distribution discharge portion 60, and is then guided to flow along both sides of the fabric within the pipe conduit 200. It is important that the heated air is equally distributed by 50% at the connecting portion of the air supply portion 30 and the air distribution discharge portion 60, so that the heated air flows at a uniform velocity within the pipe conduit 200.

Therefore, first perforated plates 40 (40*a* and 40*b*) in which a large number of holes are formed are disposed respectively at each inlet of the air passageways of the air distribution discharge portion 60. Such first perforated plates 40*a* and 40*b* form back pressure and cause the heated air to be equally divided into each inlet of the air passageways of the air distribution discharge portion 60, so that the difference in the amounts of the heated air supplied to both sides of the fabric through the air distribution discharge portion 60 can be substantially decreased.

Accordingly, even when the heated air flowing into the air distribution discharge portion 60 is not uniform, the first perforated plates 40*a* and 40*b* positioned at the inlets of the air distribution discharge portion 60 cause the heated air to be equally distributed to each air passageway thereof, thereby decreasing the difference in the extent of drying and solidifying of the fabric.

Figure 3:
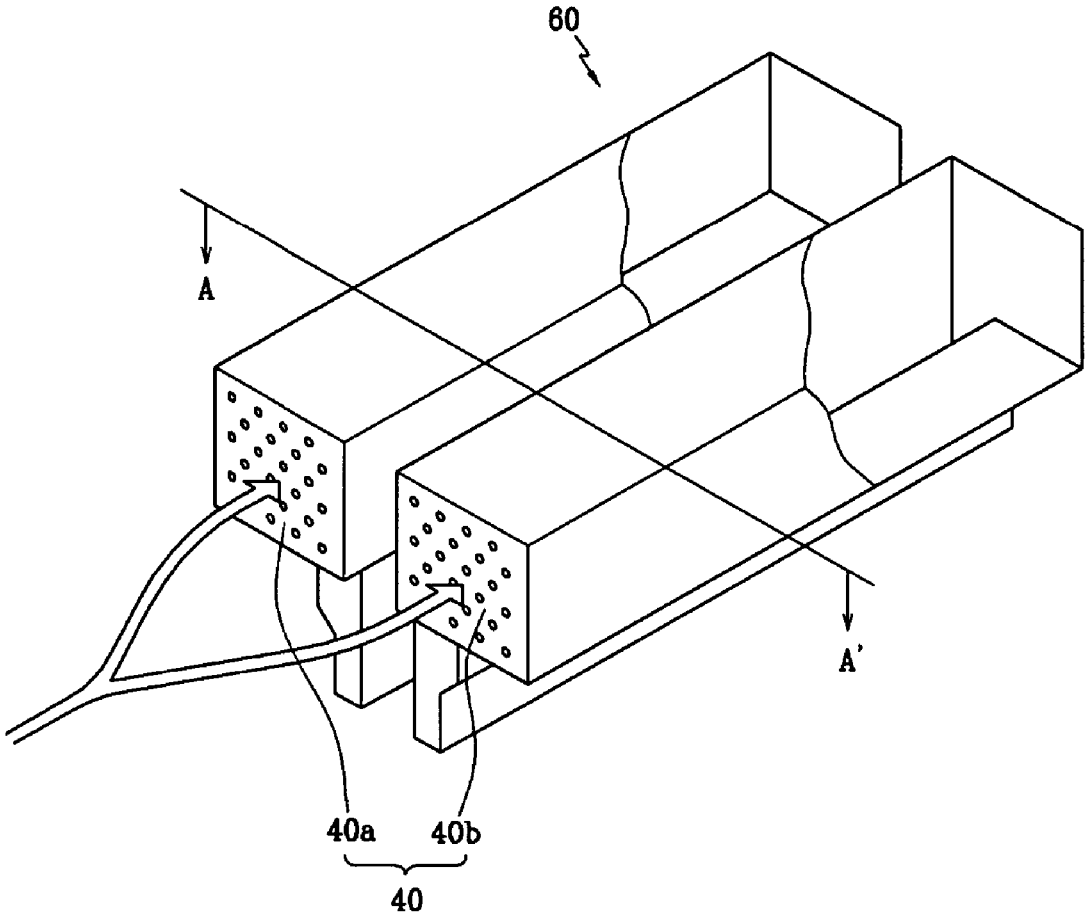
FIG. 3 shows the schematic of the air distribution discharge portion according to an embodiment of the present invention in which a portion of it is partially cut away.
Figure 4:
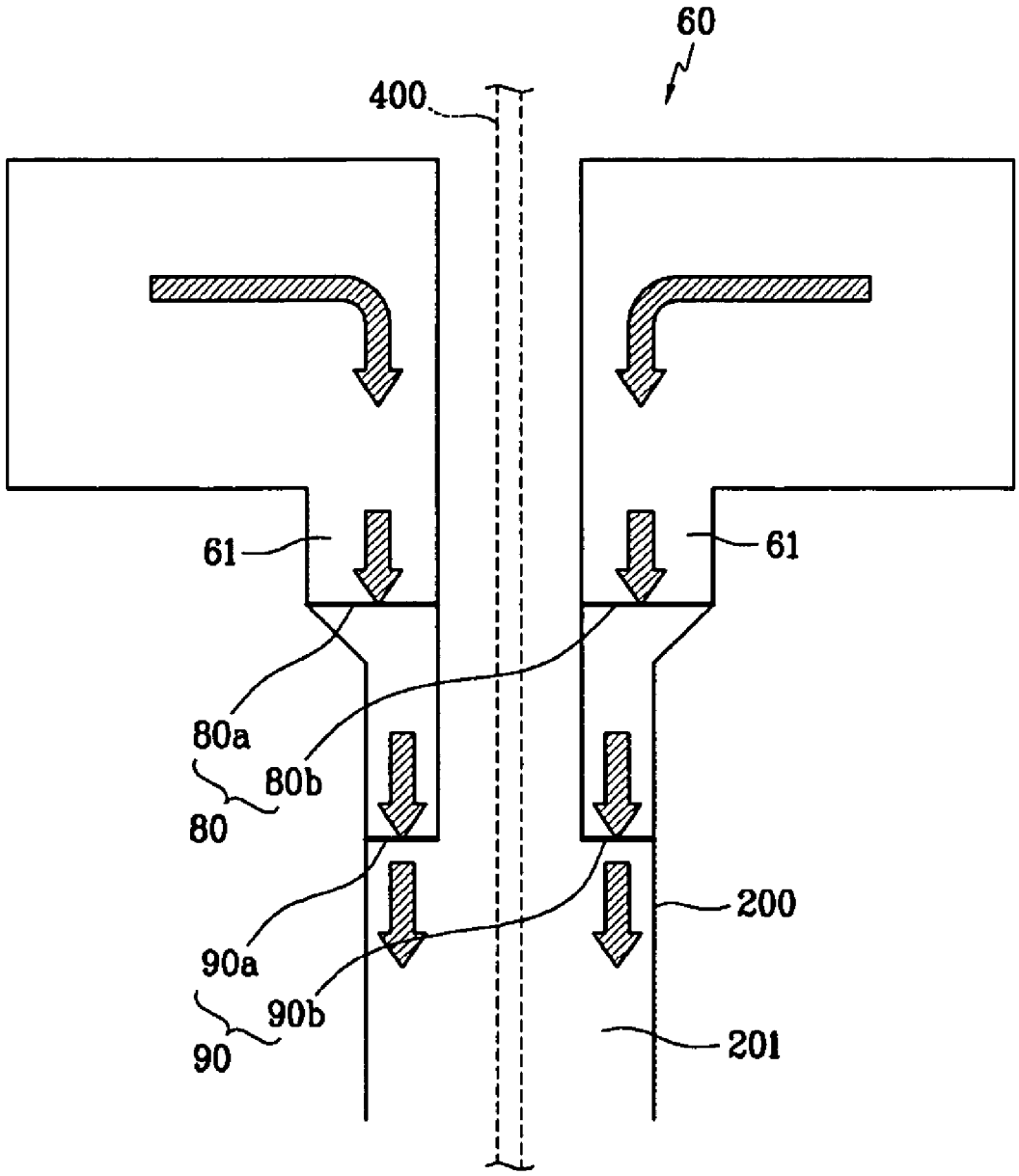
FIG.4 is a sectional view along line A-A' in FIG. 3.

FIG. 3 shows a prepreg according to an embodiment of the present invention in which a portion of an air distribution discharge portion is partially cut away, and FIG. 4 is a sectional view along line A-A' in FIG. 3.

As shown in FIGS. 3 and 4, the heated air having passed the first perforated plates 40*a* and 40*b* flows downwardly while it passes through the air passageway 61 inside the air distribution discharge portion 60.

Comparing the inner structure of air distribution discharge portion of the present invention to that of the conventional treater oven, in the present invention, guide vanes and dampers inside the air distribution discharge portion of the conventional design are totally removed. In the conventional design, the guide vanes divide the inner space of the air distribution discharge portion into 3 parts as left-center-right and the dampers control the flow rate of each divided region by guide vanes. Consequently for the air distribution discharge portion, a treater oven according to the present invention has a much simpler structure composed of only empty conduit and perforate plates, nevertheless, the distribution of the heated air is perfectly and automatically controlled by design itself without any additional operational manipulation.

After the heated air is supplied into the air distribution discharge portion 60 via the two inlets, the flow direction of the heated air is changed while passing the air passageways, and the heated air is downwardly discharged into the pipe conduit 200 through the pair of discharging outlets.

Second perforated plates 80 (80*a* and 80*b*) and third perforated plates 90 (90*a* and 90*b*) may be installed in the lower passageways of the air distribution discharge portion 60 to generate back pressure. That is, since the pressure drop of the heated air occurs across the perforated plates that are disposed in the air passageways 61 of the air distribution discharge portion 60, the initial pressure of the heated air supplied to the air distribution discharge portion 60 must become higher so as to obtain the same amount of heated air flow. Thus, the pressure difference between inlet and outlet increases. Under the conventional design, the pressure difference between inlet and outlet is relatively small, so the amount of air flow may be easily changed even by a small change of pressure. On the other hand, according to an embodiment of the present invention, the pressure difference between inlet and outlet is relatively great, thus the amount of air flow is far less changeable by a small change of pressure, so that the heated air can be uniformly distributed. Consequently, according to an embodiment of the present invention, by disposing the perforated plate in the air passageway 61 of the air distribution discharge portion 60, the heated air can be mixed more uniformly and accordingly the prepreg can be more uniformly dried.

In addition, since the back pressure is generated by the second and third perforated plates 80 and 90, a bias of the heated air, which may be caused by a change of flow direction of the air inside the air distribution discharge portion 60, can be prevented, so that the heated air can be uniformly discharged throughout the width direction of the air passageways.

Therefore, before the heated air is discharged into the pipe conduit 200, the amount of the heated air is maintained to be uniform throughout a width direction of the fabric, so that the prepreg is uniformly dried and solidified along its width direction.

It is obvious that the number and the position of the perforated plates 40, 80, and 90 may be varied depending on the shape of the air distribution discharge portion 60.

Figure 5:
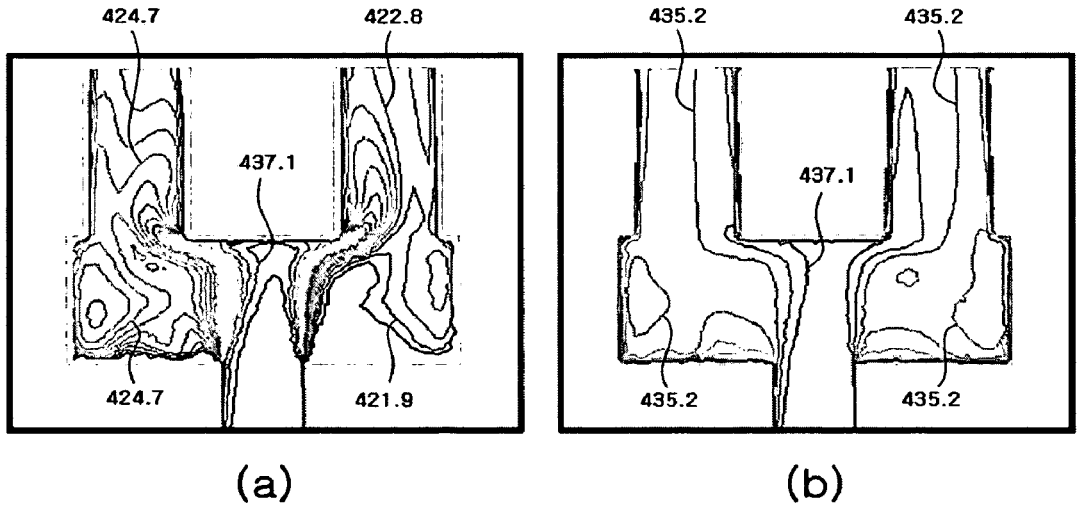
FIGS. 5*a* & 5*b* comparatively show temperature distributions of heated air while passing a single pipe, an air supply portion, and an air distribution discharge portion, respectively before and after installation of a perforated plate and a heat insulation treatment.

FIG. 5 comparatively shows the temperature distribution of heated air while passing a single pipe, an air supply portion, and an air distribution discharge portion, respectively before and after installation of the perforated plates Comparing FIGS. 5 (*a*) and (*b*), after installing perforate plates, the difference in air temperature is substantially decreased.

Figure 6:
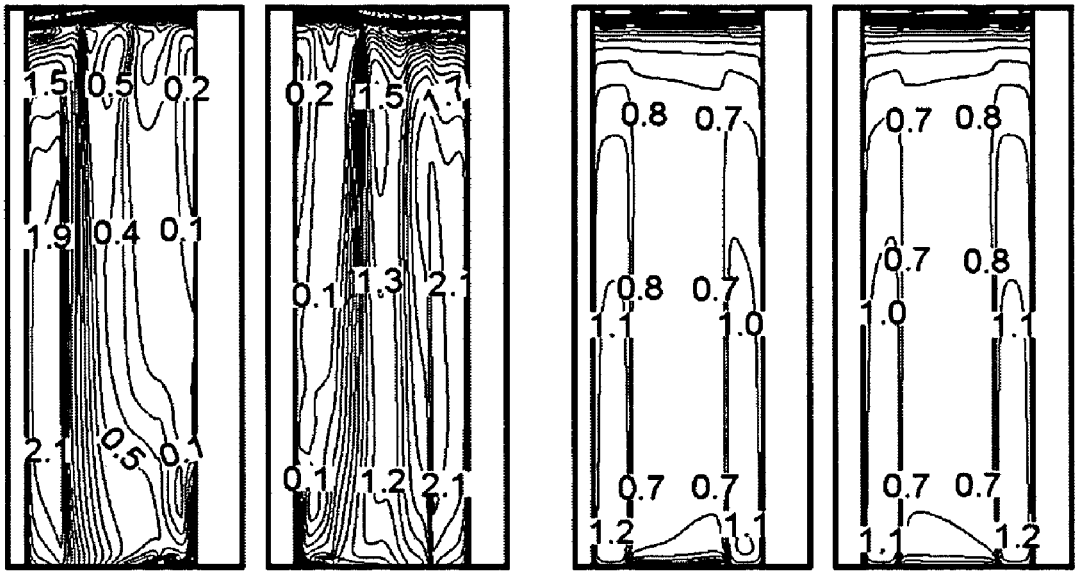
FIGS. 6*a*-6*b* comparatively show velocity distributions of heated air in a conventional oven with guide vanes and dampers and in an oven according to an embodiment of the present invention by using an empty conduit and perforate plates.

FIG. 6 comparatively shows the velocity distribution of air on the front and rear sides of the fabric, respectively before and after the embodiment of the present invention.

The velocity difference between the front and rear of the fabric is relatively great in FIG. 6 (*a*) that is for the conventional case with guide vanes and dampers inside the air distribution discharge portion. The velocity varies in a range of 0.1 to 2.1 m/s in a width direction of the fabric. On the other hand, the velocity in the front and the rear of the fabric is almost the same in FIG. 6 (*b*) that is for the present invention featured by empty conduit and perforated plates. The velocity variation in a width direction of the fabric is substantially decreased.

Figure 7:
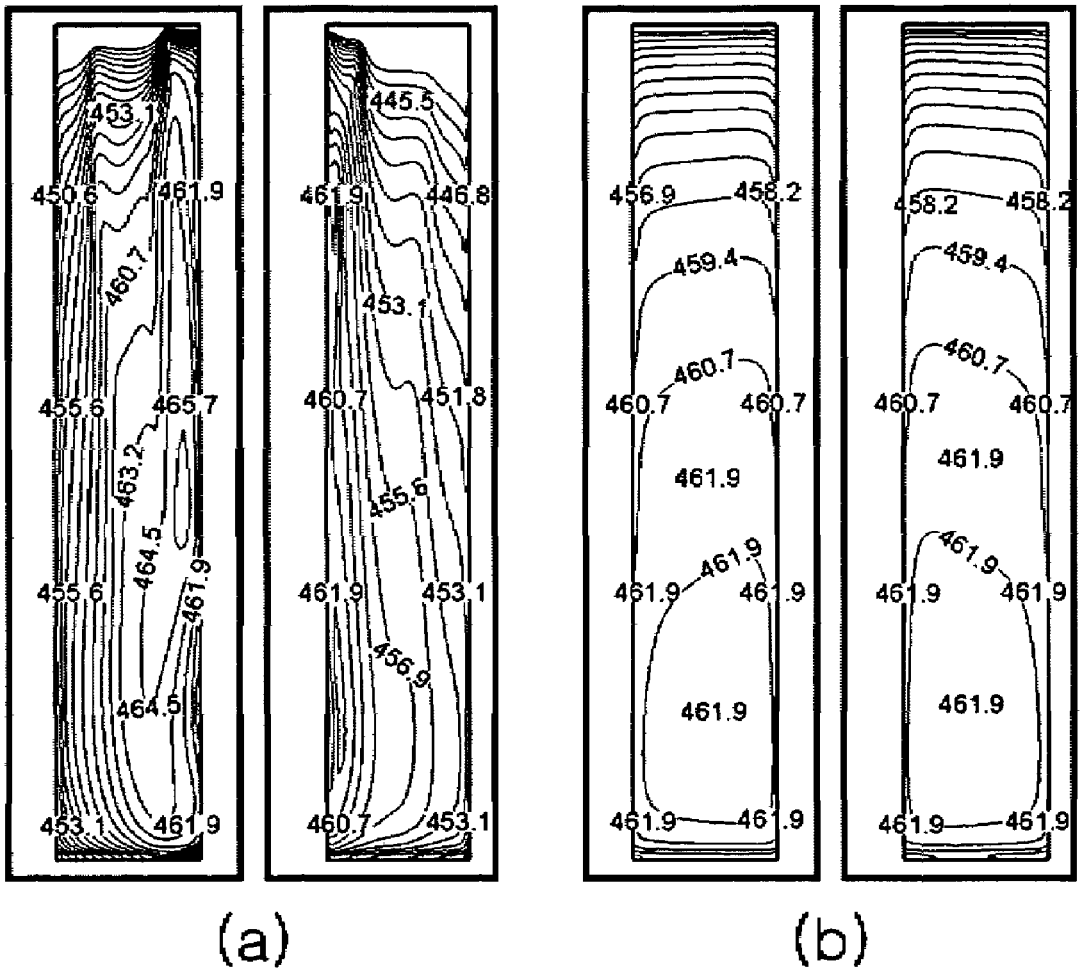
FIGS. 7*a* & 7*b* comparatively show temperature distributions on the front and rear sides of the fabric that is being dried and solidified, respectively before and after the embodiment of the present invention.

FIG. 7 comparatively shows the temperature distribution on the fabric that is being dried and solidified, respectively before and after the embodiment of the present invention characterized by the installation of perforated plates instead of guide vanes and dampers.

In FIG. 7(*a*) showing the temperature distribution for the conventional design of air distribution discharge portion with guide vanes and dampers, there is a temperature difference of maximally about 5 degrees in the front and the rear of the fabric, and a temperature difference of maximally about 15 degrees in the width direction of the fabric. On the other hand, in FIG. 7 (*b*) showing the temperature distribution after the installation of the perforated plates instead of guide vanes and dampers there is a temperature difference of about 1.3 degrees between the front and the rear sides only in the upper portion of the fabric and the temperature is substantially the same in other portions of the fabric. Further in the width direction of the fabric there is a temperature difference of about 1 degree only in the upper portion of the fabric and the temperature is substantially the same in other portions of the fabric.

While this invention has been described in connection with what is currently considered to be the most practically exemplary embodiments, it must be understood that the invention is not limited to the disclosed embodiments, but, on the contrary, is intended to cover various modifications and equivalent arrangements included within the spirit and scope of the appended claims.

In a treater oven according to an embodiment of the present invention, the heated air can be equally distributed to the front and the rear of the fabric from the inlet of the air supply portion.

In addition, in a treater oven according to an embodiment of the present invention, the heated air can be uniformly distributed and discharged from the air distribution discharge portion throughout the width direction of the fabric.

What is claimed is:

1. A treater oven for drying a prepreg, comprising:

a pipe conduit configured such that the prepreg is able to pass therethrough;

a first structure connected to one side of the pipe conduit and supplying heated air to the pipe conduit; and a second structure connected to the other side of the pipe conduit and discharging the heated air from the pipe conduit to the outside, wherein the first structure and the second structure are spaced apart from each other along a longitudinal direction of the pipe conduit, and wherein the first structure comprises:

an air supply portion connected to a heat exchanger and supplying the heated air;

an air distribution discharge portion discharging the heated air supplied from the air supply portion through a pair of discharging outlets in both sides of the prepreg; and at least one perforated plate symmetrically disposed in air passageways of the air distribution discharge portion.

2. The treater oven of claim 1, wherein an inlet for the connection with a single pipe connected to the heat exchanger is formed on one side of the air supply portion and a pair of outlets are formed on a side opposite to the inlet, and wherein the at least one perforated plate per each outlet comprises a pair of first perforated plates respectively disposed at entrances of the air passageways that are connected respectively to the pair of outlets of the air supply portion.

3. The treater oven of claim 1, wherein the air passageways of the air distribution discharge portion are formed by an empty conduit structure.

4. The treater oven of claim 2, wherein the at least one perforated plate further comprises a pair of second perforated plates that are symmetrically disposed respectively upstream of the pair of the discharging outlets of the air distribution discharge portion.

5. The treater oven of claim 4, wherein the at least one perforated plate further comprises a pair of third perforated plates that are disposed apart from the second perforated plates by a predetermined gap upstream of the pair of the discharging outlets of the air distribution discharge portion.

* * * * *